US009611675B2

(12) United States Patent
Wittelsbuerger et al.

(10) Patent No.: US 9,611,675 B2
(45) Date of Patent: Apr. 4, 2017

(54) MOTOR VEHICLE DOOR LOCK ARRANGEMENT

(71) Applicant: BROSE SCHLIESSSYSTEME GMBH & CO. KG, Wuppertal (DE)

(72) Inventors: Michael Wittelsbuerger, Lake Orion, MI (US); David Rosales, Rochester Hills, MI (US); Stepan Hanke, Lake Orion, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 6 days.

(21) Appl. No.: 14/554,624

(22) Filed: Nov. 26, 2014

(65) Prior Publication Data

US 2015/0337566 A1 Nov. 26, 2015

Related U.S. Application Data

(60) Provisional application No. 62/002,480, filed on May 23, 2014.

(51) Int. Cl.

| | |
|---|---|
| ***E05B 77/00*** | (2014.01) |
| ***E05B 77/02*** | (2014.01) |
| ***E05B 77/06*** | (2014.01) |
| ***E05B 79/20*** | (2014.01) |

(52) U.S. Cl.

CPC ..... *E05B 77/02* (2013.01); *E05B 77/06* (2013.01); *E05B 79/20* (2013.01); *Y10T 292/1043* (2015.04)

(58) Field of Classification Search

CPC ..... E05B 15/04; E05B 77/02; E05B 77/04; E05B 77/06; E05B 77/12; E05B 79/10; E05B 79/20; E05B 79/22

USPC ..... 292/92, 201, 216, 336.3, DIG. 22, 292/DIG. 23, DIG. 65

See application file for complete search history.

(56) References Cited

U.S. PATENT DOCUMENTS

| | | | | |
|---|---|---|---|---|
| 3,992,909 | A * | 11/1976 | McGhee | E05B 83/26 292/336.3 |
| 4,080,812 | A | 3/1978 | Knott et al. | |
| 4,155,233 | A * | 5/1979 | Lira | E05B 15/004 292/111 |
| 4,441,236 | A | 4/1984 | Bron et al. | |

(Continued)

FOREIGN PATENT DOCUMENTS

| | | |
|---|---|---|
| DE | 4117110 | 12/1992 |
| DE | 19511651 | 10/1995 |

(Continued)

OTHER PUBLICATIONS

European Search Report for corresponding European Patent Application No. 10016238, mailed Sep. 17, 2015 (4 pages).

(Continued)

*Primary Examiner* — Janet M Wilkens

(74) *Attorney, Agent, or Firm* — Pauly, Devries Smith & Defner, LLC

(57) ABSTRACT

A motor vehicle door lock arrangement has a motor vehicle lock and a force transmission chain. An actuation movement may be transmitted via the force transmission chain for opening of the motor vehicle lock. A crash coupling arrangement is provided between two force transmission chain sections, and includes a deflectable coupling element that is at least partly bendable.

17 Claims, 4 Drawing Sheets

(56) References Cited

U.S. PATENT DOCUMENTS

| | | | | |
|---|---|---|---|---|
| 4,616,862 | A * | 10/1986 | Ward | E05B 13/005 292/201 |
| 5,865,481 | A | 2/1999 | Buschmann | |
| 6,042,159 | A * | 3/2000 | Spitzley | E05B 77/06 16/111.1 |
| 6,099,052 | A * | 8/2000 | Spitzley | E05B 77/06 292/336.3 |
| 6,464,270 | B1 * | 10/2002 | Sloan | E05B 77/06 292/336.3 |
| 7,597,368 | B2 | 10/2009 | Savant et al. | |
| 8,056,944 | B2 | 11/2011 | Jankowski et al. | |
| 8,152,209 | B2 * | 4/2012 | Lee | E05B 77/06 292/336.3 |
| 8,322,077 | B2 | 12/2012 | Papanikolaou et al. | |
| 8,414,038 | B2 * | 4/2013 | Bedekar | E05B 77/04 292/216 |
| 2003/0057698 | A1 | 3/2003 | Parrott et al. | |
| 2003/0080572 | A1 * | 5/2003 | So | E05B 83/24 292/336.3 |
| 2003/0234544 | A1 | 12/2003 | Jankowski et al. | |
| 2004/0251693 | A1 * | 12/2004 | Schoen | E05B 77/06 292/1 |
| 2007/0120382 | A1 * | 5/2007 | Chevalier | E05B 77/06 292/336.3 |
| 2009/0243307 | A1 | 10/2009 | Lee | |
| 2009/0309374 | A1 | 12/2009 | Lennhoff et al. | |
| 2009/0322105 | A1 | 12/2009 | Lee et al. | |
| 2010/0109350 | A1 * | 5/2010 | Gschweng | E05B 17/0062 292/196 |
| 2010/0207404 | A1 | 8/2010 | Corwin et al. | |
| 2011/0062747 | A1 * | 3/2011 | Teramoto | E05B 77/04 296/146.1 |
| 2011/0084505 | A1 | 4/2011 | Brose et al. | |
| 2011/0115252 | A1 | 5/2011 | Higgins et al. | |
| 2011/0181052 | A1 | 7/2011 | Brose et al. | |
| 2011/0258935 | A1 * | 10/2011 | Heller | B60J 5/0451 49/502 |
| 2011/0259061 | A1 | 10/2011 | Brose et al. | |
| 2013/0140831 | A1 * | 6/2013 | Kempel | E05B 83/26 292/3 |
| 2014/0284940 | A1 * | 9/2014 | Rosales | E05B 77/04 292/92 |
| 2014/0292005 | A1 * | 10/2014 | Bendel | E05B 77/06 292/336.3 |
| 2014/0312630 | A1 * | 10/2014 | Bendel | E05B 77/06 292/195 |
| 2016/0097223 | A1 | 4/2016 | Rosales et al. | |

FOREIGN PATENT DOCUMENTS

| | | |
|---|---|---|
| DE | 1014965 | 10/2002 |
| DE | 202006011206 | 1/2008 |
| DE | 102008036356 | 10/2009 |
| DE | 202011002154 | 6/2012 |
| EP | 0684357 | 11/1995 |
| EP | 1050640 | 11/2000 |
| EP | 1052355 | 11/2000 |
| EP | 2636826 | 9/2013 |
| EP | 2636827 | 9/2013 |
| FR | 2876135 | 4/2006 |
| GB | 1324131 | 7/1973 |
| GB | 2432184 | 5/2007 |
| WO | 2014019960 | 2/2014 |

OTHER PUBLICATIONS

Non-Final Office Action for U.S. Appl. No. 12/978,479, mailed Jun. 30, 2015 (13 pages).

Non-Final Office Action for U.S. Appl. No. 12/978,479, mailed Mar. 28, 2014 (18 pages).

Non-Final Office Action for U.S. Appl. No. 12/978,479, mailed on Dec. 16, 2014 (7 pages).

Final Office Action for U.S. Appl. No. 12/978,479 mailed Jan. 15, 2016 (18 pages).

German Search Report for German Patent Application No. 10 2015 108 203.9 (priority to U.S. Appl. No. 14/554,624, mailed May 24, 2016 (7 pages).

Extended European Search Report for European Patent Application No. 15179233 related to co-pending U.S. Appl. No. 14/815,590 mailed Dec. 22, 2015 (7 pages).

Non-Final Office Action for U.S. Appl. No. 14/815,590, mailed May 3, 2016 (15 pages).

* cited by examiner

MOTOR VEHICLE DOOR LOCK ARRANGEMENT

CLAIM OF PRIORITY

This application claims the benefit of U.S. Provisional Application No. 62/002,480, filed May 23, 2014, the content of which is hereby incorporated herein by reference in its entirety.

FIELD OF THE INVENTION

The invention is directed to a motor vehicle door lock arrangement and to a crash coupling arrangement.

BACKGROUND

Crash safety plays an important role for today's motor vehicle locks. It is in particular important that neither crash induced acceleration nor crash induced deformation leads to an accidental and unintended opening of the motor vehicle door which the motor vehicle lock is assigned to. Embodiments described in the present application relate to preventing an unintended opening of the motor vehicle door based on crash induced acceleration.

Because the outer door handle, which is connected to the motor vehicle lock via a force transmission chain, comprises an inertial mass which is not rigidly connected to the vehicle door, the outer door handle does not immediately follow the movement of the motor vehicle door which is due to the acceleration stemming from the impact. As a result, a relative movement between the outer door handle and the motor vehicle door is caused, which may correspond to an opening movement of the outer door handle and thereby lead to an unintended opening of the motor vehicle lock and accordingly of the motor vehicle door.

The known motor vehicle lock (US 2011/0181052 A1), which is the starting point for the present invention, is provided with the usual lock elements catch and pawl, wherein the pawl may be deflected into a release position by actuation of a pawl actuation lever.

To guarantee a high crash safety the known motor vehicle lock comprises a crash element, which is designed as a bendable wire. By the accelerations which occur during a crash, the crash element moves into a blocking position in which the crash element blocks further actuation of the pawl actuation lever.

One disadvantage of the known motor vehicle lock is the fact that, before the intended blocking of the pawl actuation lever takes place, the crash element has to perform the above noted movement into the blocking position. The necessity of the movement of the crash element before the intended blocking takes place leads to undesirable reaction times of the crash safety function.

Furthermore for the known motor vehicle lock, the constructional design of the force transmission chain between the door handle and the pawl appears to be challenging. This is true as in a crash situation not only the pawl actuation lever, but in fact the whole force transmission chain starting from the door handle to the pawl actuation lever it is being blocked. In order not to run the risk of an unpredictable breakage of some component in this force transmission chain, i.e., even some component other than the pawl actuation lever, it has to be designed for exceptionally high forces. This is especially true for the crash element, it being designed as a bendable wire.

One object of the invention is to improve the known motor vehicle door lock arrangement such that a cost effective constructional design is possible without reducing the resulting crash safety.

SUMMARY

Embodiments of the invention providing a motor vehicle door lock arrangement solve the above noted object. The motor vehicle door lock arrangement in question at least comprises a motor vehicle lock, which is assigned to a motor vehicle door arrangement. The motor vehicle door arrangement comprises at least a motor vehicle door. The expression "door" is to be understood in a broad sense. It includes in particular side doors, back doors, lift gates, trunk lids or engine hoods. Such a motor vehicle door can generally be designed as a sliding door as well.

An important recognition underlying the present invention is that it is better to have a component freewheel in the case of a crash rather than to block a moving component in the case of a crash. This is because, as was already pointed out, in the case of a crash the door handle may experience a very fast relative movement to the vehicle door, thereby causing a very high velocity of the moving component which again may cause that moving component or some other part involved to break when it is being blocked. If, on the other hand, the moving component is freewheeling in case of a crash, there is no impact associated with the crash. This teaching is referred to as a "freewheeling crash concept" in the following disclosure.

A distinction between the crash situation and a normal operation situation of the door handle may then be made based on the level of acceleration or speed with which the door handle is moved. Very high velocity or acceleration is indicative of a crash state. Therefore, according to the invention, the inertial properties of the motor vehicle door lock arrangement may be exploited, such that in cases of high acceleration or velocity a freewheeling movement of the door handle is performed, whereas in the cases of lower acceleration or velocity deflection of the pawl by the door handle is possible.

In further detail the proposed motor vehicle door lock arrangement comprises a force transmission chain, wherein an actuation movement, in particular an actuation movement initiated by manual operation of an outer door handle, may be transmitted via the force transmission chain for opening of the motor vehicle lock.

It is of particular importance for the invention that a crash coupling arrangement is provided between two force transmission chain sections of the force transmission chain, which crash coupling arrangement comprises a deflectable coupling element. Depending on the position of the coupling element the two force transmission chain sections are being interconnected or disconnected respectively.

The inertial characteristic of the coupling element is such that the two force transmission chain sections become or stay disconnected, when the actuation movement surpasses a rapidity threshold. This means that an actuation movement of an outer door handle, which is induced by high crash accelerations, may run free without deflecting the pawl of the motor vehicle lock. When the actuation movement is below the rapidity threshold, however, the two force transmission chain sections become or stay connected such that an actuation movement induced by normal operation of an outer door handle leads to a deflection of the pawl of the motor vehicle lock, as far as the locking state of the motor vehicle lock allows such deflection of the pawl.

An interesting aspect of the present invention is the fact that the coupling element is not exposed to any extreme forces, even in a case of a crash. Based on this it has been concluded that the coupling element may well be realized at least partly bendable, wherein the coupling element is deflectable into its respective positions by bending it into those positions. The realization of the coupling element as a bendable coupling element is cost effective and, with the above noted freewheeling concept, can be mechanically weak without any risk of the coupling element collapsing during a crash. The cost effectiveness is at least partly based on the fact that for deflecting the coupling element no hinge arrangement is necessary.

An embodiment is directed to the coupling element being elastically bendable, such that a return spring or the like for the coupling element is not in any case necessary or may be laid out cost effectively. It is particularly cost effective, if the coupling element comprises an elastically bendable wire or strip for providing said bendability.

Some embodiments are directed to advantageous constructional solutions that lead to an altogether cost effective and robust realization of the crash coupling arrangement.

In an embodiment, at least one section of the force transmission chain is part of the motor vehicle lock. For example, depending on the overall structure of the motor vehicle door lock arrangement it may be favorable to realize the crash coupling arrangement as an integral part of the motor vehicle lock, while one section of the force transmission chain is provided separately from the motor vehicle lock. In this case, the separate force transmission chain section is realized as a bowden arrangement.

Generally, it is possible that the complete force transmission chain as well as the crash coupling arrangement with the bendable coupling element are realized as integral parts of the motor vehicle.

Also it may be possible to realize the force transmission chain as well as the crash coupling arrangement separately from the motor vehicle lock. In this case, both force transmission chain sections are realized as bowden arrangements that are coupled by the crash coupling arrangement.

Finally, it may be advantageous that the motor vehicle door lock arrangement comprises a door handle, wherein at least one section of the force transmission chain is part of the door handle. In this case, the crash coupling element is part of the door handle.

Instead of being an integral part of the motor vehicle lock or the door handle, in the above noted cases, the crash coupling arrangement may be attached to the motor vehicle lock respective the door handle.

One embodiment is directed to a configuration noted above, in which the crash coupling arrangement is provided separately from the motor vehicle lock, which makes it easily possible to provide two product alternatives, one including the crash coupling arrangement and one excluding the crash coupling arrangement.

An embodiment is directed to at least one force transmission chain section comprising a bowden arrangement with a bowden cable and a bowden sheath surrounding the bowden cable, wherein the deflectable coupling element is provided by the respective bowden cable. This double use of the bowden cable allows the realization of a particularly compact and cost effective structure.

An embodiment is directed to a motor vehicle door lock arrangement, which is of a basically similar structure, such that all explanations given for the first teaching are generally applicable to the second teaching.

However, it has been discovered that the above noted freewheeling crash concept allows a mechanically weak realization of the crash coupling arrangement, as no high blocking forces occur. This is why according to a second teaching it is proposed to provide the crash coupling arrangement separately from the motor vehicle lock which may, for example, be an integration into a force transmission chain consisting of bowden arrangements. It is to be noted that according to this second teaching all kinds of constructional concepts for the crash coupling arrangement are applicable. A bendable coupling element is not necessarily realized.

An embodiment is directed to the crash coupling arrangement as such, which is realized separately from the motor vehicle lock. All explanations given to the first two teachings are fully applicable to this third teaching.

In an embodiment, the invention provides a motor vehicle door lock arrangement with a motor vehicle lock, wherein a force transmission chain is provided and wherein an actuation movement may be transmitted via the force transmission chain for opening of the motor vehicle lock, wherein a crash coupling arrangement is provided between two force transmission chain sections, which comprises a coupling element with a coupling contour assigned to one force transmission chain section and which comprises a counter contour assigned to the other force transmission chain section, wherein the coupling element is deflectable into a coupling position, in which its coupling contour is coupled to the counter contour, thereby interconnecting the two force transmission chain sections, and into a decoupling position, in which its coupling contour is decoupled from the counter contour, thereby disconnecting the two force transmission chain sections, wherein an inertial characteristic of the coupling element causes the coupling contour to become or to stay decoupled from the counter contour, when the actuation movement surpasses a rapidity threshold, and causes the coupling contour to become or to stay coupled to the counter contour, when the actuation movement is below the rapidity threshold, wherein the coupling element is at least partly bendable and wherein the coupling element is deflectable into said positions by bending it into said positions.

In an embodiment, the motor vehicle lock comprises a catch and a pawl, which is assigned to the catch, wherein the catch can be brought into an opening position and into a closed position, wherein the catch, which is in the closed position, is or may be brought into holding engagement with a lock striker, wherein the pawl may be brought into an engagement position, in which it is in blocking engagement with the catch, wherein for opening of the motor vehicle lock the pawl may be deflected into a release position, in which it releases the catch.

In an embodiment, for deflecting the coupling element, the coupling element is elastically bendable. In an embodiment, for deflecting the coupling element, the coupling element comprises an elastically bendable wire or strip.

In an embodiment, the actuation movement of the force transmission chain goes along with an actuation movement of the coupling element, which actuation movement of the coupling element is oriented basically laterally with respect to the deflection movement of the coupling element.

In an embodiment, the coupling element is spring biased into its coupling position. In an embodiment, the spring bias is provided by a coupling spring. In an embodiment, the spring bias is provided by the elastic bendability of the coupling spring.

In an embodiment, the actuation movement of the force transmission chain is followed by a reverse movement of the force transmission chain back into its non actuated state.

In an embodiment, the actuation movement comprises an inertia movement section, which is followed by a driving movement section, wherein during the inertia movement section the inertial characteristic of the coupling element causes coupling to or decoupling from the counter contour depending on the rapidity of the actuation movement and wherein during the driving movement section the actuation movement is being transmitted to the motor vehicle lock or runs free depending on the coupling state of the crash coupling arrangement. In an embodiment, during the inertia movement section, depending on the rapidity of the actuation movement, the coupling contour falls into coupling engagement with the counter contour or passes the counter contour.

In an embodiment, during the reverse movement the coupling element is deflected into its decoupling position. In an embodiment, a reset contour is provided and the coupling element slides along the reset contour during the reverse movement deflecting the coupling element into the decoupling position.

In an embodiment, a reset spring is provided for spring biasing the coupling element along the reset contour.

In an embodiment, a blocking contour is arranged at the counter contour which prevents the coupling element from falling into the coupling position during the non actuated state of the force transmission chain.

In an embodiment, the counter contour is hook-shaped and that in the coupling position the coupling element is hooked to the counter contour.

In an embodiment, at least one section of the force transmission chain is part of the motor vehicle lock. In an embodiment, the counter contour is part of an actuating lever of the motor vehicle lock.

In an embodiment, the crash coupling arrangement is provided separately from the motor vehicle lock and/or wherein at least one force transmission chain section is provided separately from the motor vehicle lock.

In an embodiment, at least one force transmission chain section comprises a bowden arrangement with a bowden cable and a bowden sheath, and the respective bowden cable provides the deflectable coupling element. In an embodiment, the spring bias of the coupling element into its coupling position goes back on the bending elasticity of the bowden cable of the respective force transmission chain.

In an embodiment, the invention provides a motor vehicle door lock arrangement with a motor vehicle lock, wherein a force transmission chain is provided and wherein an actuation movement may be transmitted via the force transmission chain for opening of the motor vehicle lock, wherein a crash coupling arrangement is provided between two force transmission chain sections, which comprises a coupling element with a coupling contour assigned to one force transmission chain section and which comprises a counter contour assigned to the other force transmission chain section, wherein the coupling element is deflectable into a coupling position, in which its coupling contour is coupled to the counter contour, thereby interconnecting the two force transmission chain sections, and into a decoupling position, in which its coupling contour is decoupled from the counter contour, thereby disconnecting the two force transmission chain sections, wherein an inertial characteristic of the coupling element causes the coupling contour to become or to stay decoupled from the counter contour, when the actuation movement surpasses a rapidity threshold, and causes the coupling contour to become or to stay coupled to the counter contour, when the actuation movement is below the rapidity threshold, wherein the crash coupling arrangement is provided separately from the motor vehicle lock.

In an embodiment, at least one force transmission chain section comprises a bowden arrangement with a bowden cable and a bowden sheath, wherein the respective bowden cable provides the deflectable coupling element.

In an embodiment, the invention provides a crash coupling arrangement for the insertion between two sections of a force transmission chain for a motor vehicle lock, wherein in the installed state, an actuation movement may be transmitted via the force transmission chain for opening of the motor vehicle lock, wherein the crash coupling arrangement comprises a coupling element with a coupling contour assigned to one force transmission chain section and comprises a counter contour assigned to the other force transmission chain section, wherein the coupling element is deflectable into a coupling position, in which its coupling contour is coupled to the counter contour, thereby interconnecting the two force transmission chain sections, and into a decoupling position, in which its coupling contour is decoupled from the counter contour, thereby disconnecting the two force transmission chain sections, wherein an inertial characteristic of the coupling element causes the coupling contour to become or to stay decoupled from the counter contour, when the actuation movement surpasses a rapidity threshold, and causes the coupling contour to become or to stay coupled to the counter contour, when the actuation movement is below the rapidity threshold.

In an embodiment, at least one force transmission chain section comprises a bowden arrangement with a bowden cable and a bowden sheath, wherein the respective bowden cable provides the deflectable coupling element.

In an embodiment, the crash coupling arrangement comprises a housing, which carries the coupling element with its coupling contour and which carries the counter contour.

BRIEF DESCRIPTION OF THE FIGURES

Some embodiments will hereinafter be described in conjunction with the appended drawings, in which.

DETAILED DESCRIPTION

Referring to the figures, the motor vehicle door arrangement 1 comprises a motor vehicle lock 2. It may also comprise, as shown in FIG. 1, a door handle 3, which here is an outer door handle.

Figure 1:
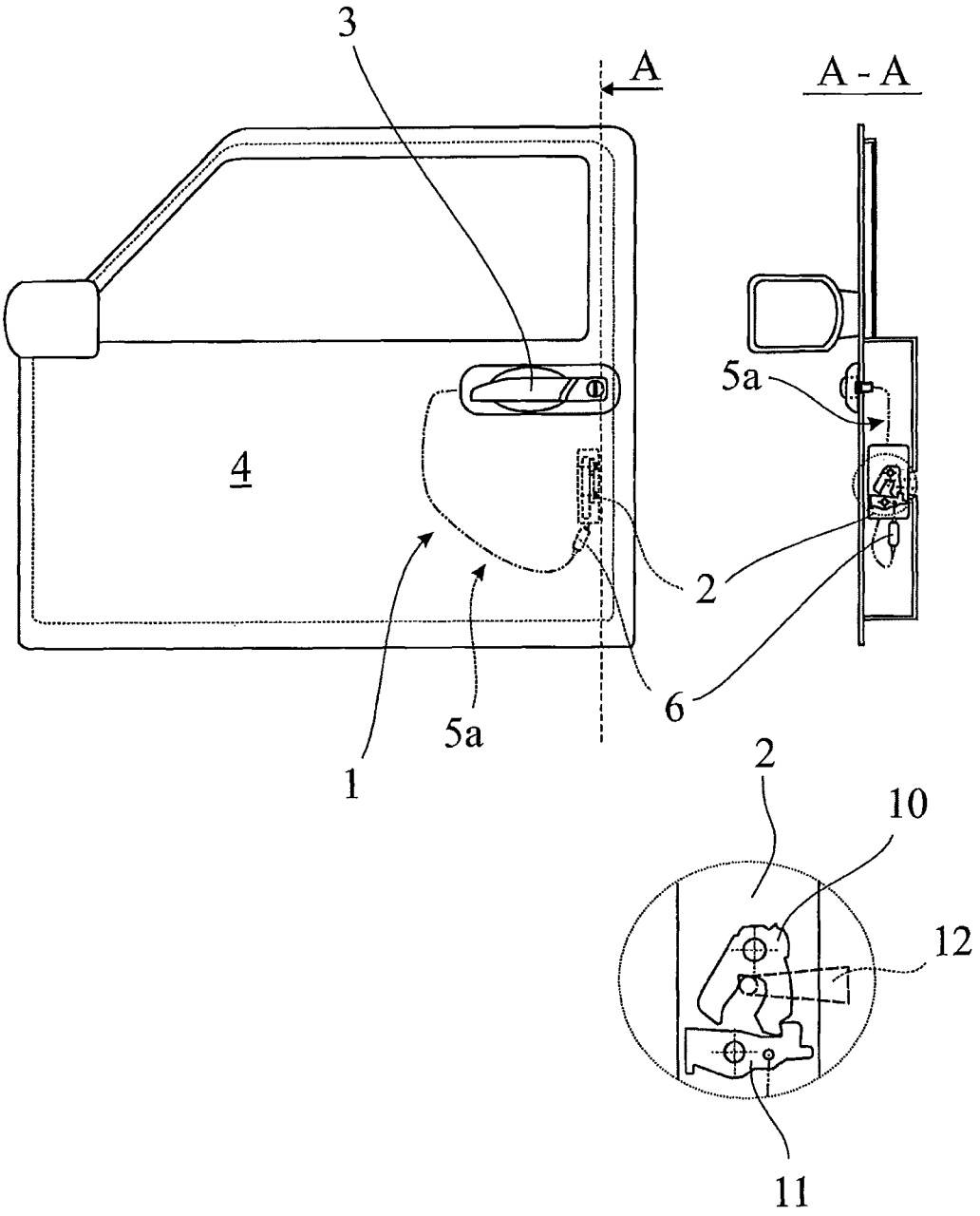
FIG. 1 illustrates a motor vehicle door lock arrangement in the installed state.

The motor vehicle lock 2 shown in the drawings is assigned to a motor vehicle door arrangement which comprises the motor vehicle door 4 as also shown in FIG. 1.

Regarding the broad interpretation of the expression "door" reference is made to the introductory part of the specification. Here the motor vehicle door 4 is a side door of the motor vehicle.

FIG. 1 shows that a force transmission chain 5 is provided, wherein an actuation movement, induced by a manual operation of the door handle 3, may be transmitted via the force transmission chain 5 to the motor vehicle door 2 in order to open the motor vehicle lock 2.

The motor vehicle lock 2 comprises a lock mechanism (not shown) which allows to bring the motor vehicle lock 2 into a different locking states like "unlocked" or "locked". In the locking state "unlocked" an actuation movement induced by the door handle 3 leads to opening of the motor vehicle lock 2. In the locking state "locked", the actuation movement runs free.

The force transmission chain 5 comprises at least two force transmission chain sections 5*a*, 5*b*, wherein one force transmission chain section 5*a* is at least partly realized as a bowden arrangement and wherein the other force transmission chain section 5*b* is part of the motor vehicle lock 2. Other mechanical structures of the force transmission chain 5 are possible, as will be explained later.

In order to prevent an unintended opening of the motor vehicle lock 2 and in the end an unintended opening of the motor vehicle door 4, a crash coupling arrangement 6 is provided between the two force transmission chain sections 5*a*, 5*b*. The general idea underlying the crash coupling arrangement 6 is to disconnect the two force transmission chain sections 5*a*, 5*b* in the case that high crash accelerations lead to an actuation movement with high rapidity. For this, the crash coupling arrangement 6 comprises a coupling element 7 with a coupling contour 8, which is assigned to one force transmission chain section 5*a*. The crash coupling arrangement 6 also comprises a counter contour 9, which is assigned to the other force transmission chain section 5*b*, as may be taken from FIG. 3.

The coupling element 7 is deflectable into a coupling position (FIG. 3*b, c*), in which its coupling contour 8 is coupled to the counter contour 9, thereby interconnecting the two force transmission chain sections 5*a*, 5*b*. The coupling element 7 is also deflectable into a decoupling position (FIG. 3*a*), in which its coupling contour 8 is decoupled from the counter contour 9, thereby disconnecting the two force transmission chain sections 5*a*, 5*b*.

Figure 3:
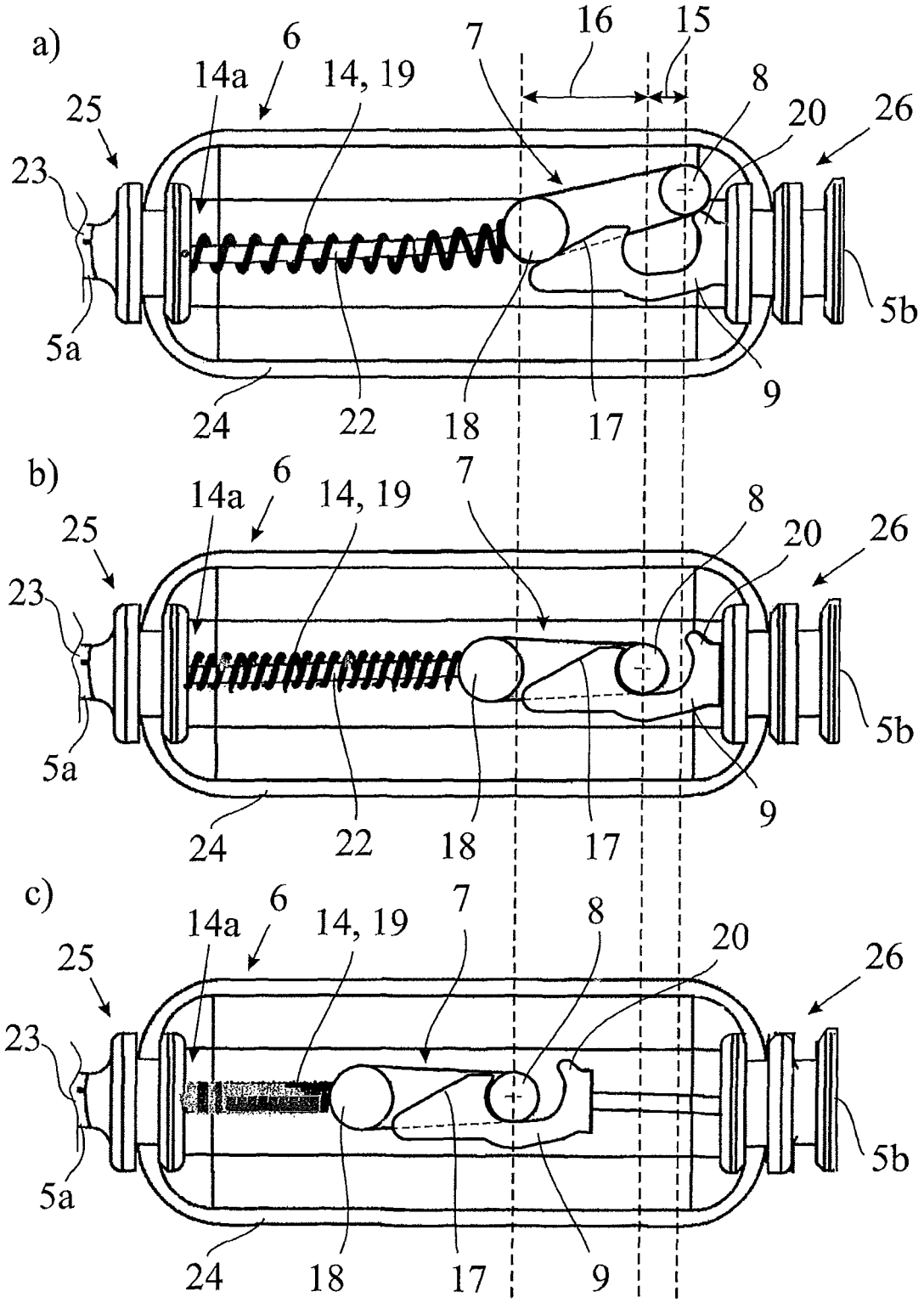
FIG. 3 illustrates the crash coupling arrangement shown in FIG. 2*b*) during normal operation in top view a) in the non-actuated state, b) during the inertia movement section and c) during the driving movement section.

The above noted freewheeling crash concept is now based on the idea that an inertial characteristic of the coupling element 7 causes the coupling contour 8 to become or to stay decoupled from the counter contour 9, when the actuation movement surpasses a rapidity threshold (FIG. 4), and causes the coupling contour 8 to become or to stay coupled to the counter contour 9, when the actuation movement is below the rapidity threshold (FIG. 3).

Figure 4:
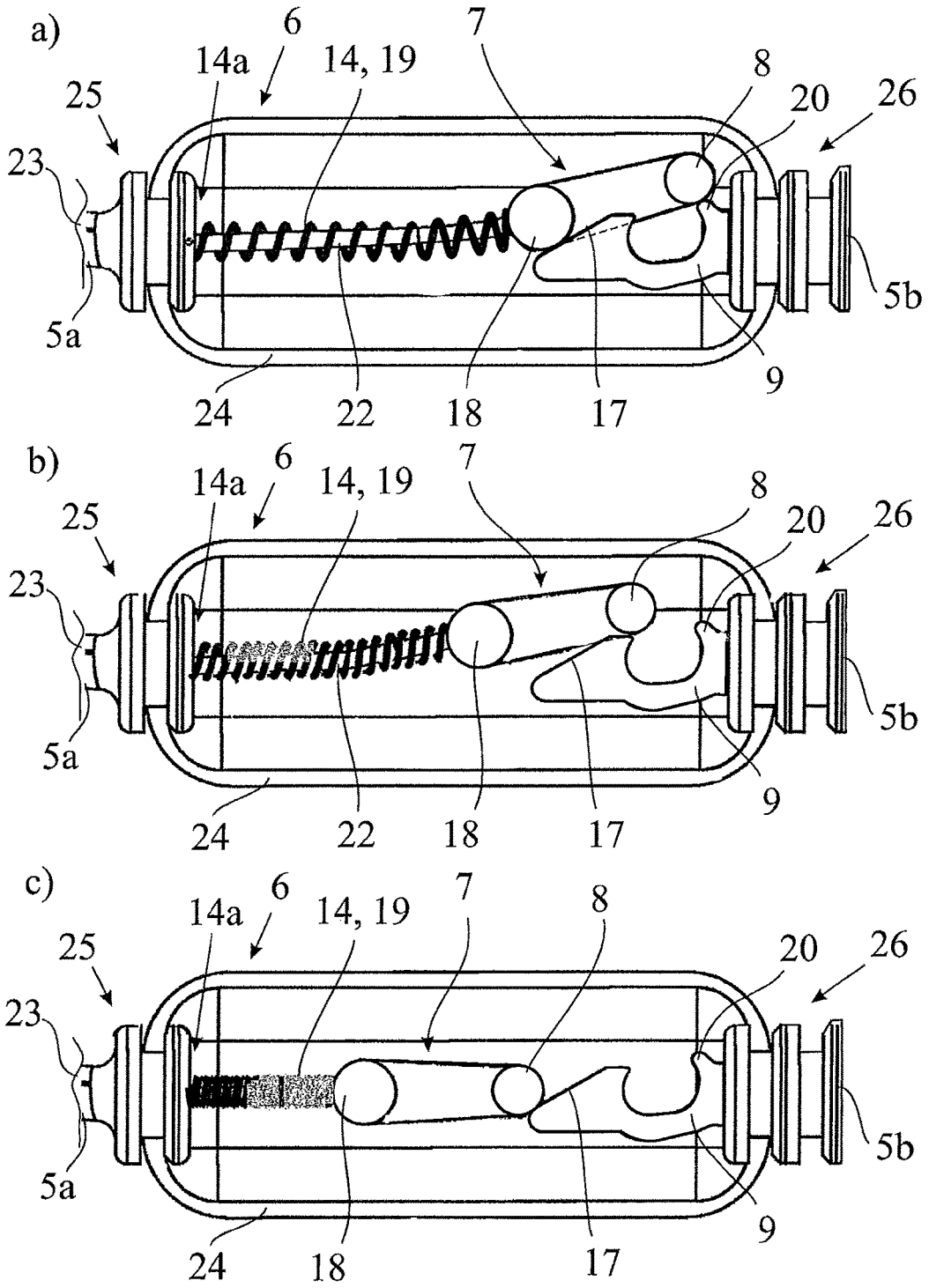
FIG. 4 illustrates the crash coupling arrangement in a crash situation a) in the non-actuated state, b) during the inertia movement section and c) during the driving movement section.

FIGS. 3 and 4 show that the coupling element 7 is at least partly bendable, wherein the coupling element 7 is deflectable into the above noted positions by bending it into those positions. As noted above, a hinge arrangement is not necessary according to this first teaching.

It will be explained later in detail that FIG. 3 shows the normal operation of the crash coupling arrangement 6. Starting from the non-actuated state in FIG. 3*a*, a normal actuation movement induced by the door handle 3 leads to spring biased falling of the coupling element 7 into its coupling position shown in FIG. 3*b*. Further actuation leads to the force transmission chain section 5*a* pulling the force transmission chain section 5*b* in FIG. 3 to the left.

FIG. 4 shows a crash situation, in which an unintended actuation movement is induced by crash accelerations. Starting from the non-actuated state in FIG. 4*a* the very rapid, crash induced actuation movement does not allow the coupling element 7 to fall into its coupling position, before it passes the counter contour 9. When the coupling element 7 finally reaches its coupling position, it travelled way passed the counter contour 9 and runs free, as shown in FIG. 4*c*.

The present invention may be applied to motor vehicle locks 2 of different structure. Here the motor vehicle lock 2 comprises a catch 10 and a pawl 11, which is assigned to the catch 10. The catch 10 can be brought into an opening position (not shown) and into a closed position (FIG. 1), wherein the catch 10, which is in the closed position, is in holding engagement with a lock striker 12, which is shown in dotted lines in FIG. 1. The pawl 11 may be brought into an engagement position (FIG. 1), in which it is in blocking engagement with the catch 10. For opening of the motor vehicle lock 2 the pawl 11 may be deflected into a release position, in which it releases the catch 10. In the detail view of FIG. 1 such deflection of the pawl 11 for opening of the motor vehicle lock 2 would be a pivot movement of the pawl 11 in a clockwise direction. The motor vehicle lock 2 comprises an actuation lever 13, which actuation leads to deflecting the pawl 11 for opening of the motor vehicle lock 2, if the locking mechanism of the motor vehicle lock 2 is in the respective blocking state.

In the shown embodiment, one force transmission chain section 5*b* is connected to the actuation lever 13 of the motor vehicle lock 2.

In an embodiment, for deflecting the coupling element 7, the coupling element 7 is elastically bendable. The bendability of the coupling element 7 may be realized in various ways. For example, the coupling element 7 may comprise an elastically bendable wire or strip. The bendable section of the coupling element 7 may be of metal, plastic, rubber or the like.

The actuation movement of the force transmission chain 5 goes along with an actuation movement of the coupling element 7. The actuation movement in FIGS. 3 and 4 is a movement to the left. In an embodiment, the actuation movement of the coupling element 7 is oriented basically laterally with respect to the deflection movement of the coupling element 7, which deflection movement in FIGS. 3 and 4 is an up and down movement.

In the shown drawings the coupling element 7 is spring biased into its coupling position. In an embodiment, the spring bias is provided by a coupling spring 14, which can be realized as a pressure spring. Generally, the coupling spring 14 may be realized as a tension spring as well. In an embodiment, the coupling spring 14 is a spiral spring, as shown in the drawings. The coupling spring 14 shown in FIGS. 3 and 4 provides said spring bias with its bendability around a bending axis, which is perpendicular to the longitudinal extension of the coupling spring 14. The coupling spring 14 is fixed at one end 14*a* in order to be able to provide the spring bias. The spring bias is therewith provided by the elastic bendability of the coupling spring 14.

Alternatively, the above noted spring bias of the coupling element 7 may be provided by the elasticity of the coupling element 7 itself. Depending on the mechanical structure of the coupling element 7, an above noted coupling spring 14 is necessary or may be omitted.

An actuation movement of the force transmission chain 5 in an embodiment is generally followed by a reverse movement of the force transmission chain 5 back into its non-actuated state (FIG. 3*a*, 4*a*). The actuation movement during normal operation goes along with deflecting of the pawl 11 into its release position, if the locking mechanism of the motor vehicle lock 2 is in a respective locking state. The reverse movement of the force transmission chain 5 only serves as a reset of the force transmission chain 5 into its non-actuated state.

In an embodiment, the actuation movement comprises an inertia movement section 15, which is followed by a driving movement section 16, wherein during the inertia movement section 15 the inertial characteristic of the coupling element 7 causes coupling to or decoupling from the counter contour 9 depending on the rapidity of the actuation movement. This may be apparent from a comparison of FIG. 3 and FIG. 4.

During the driving movement section 16 the actuation movement is being transmitted to the motor vehicle lock 2 or runs free depending on the coupling state of the crash coupling arrangement 6. This becomes clear from a comparison of FIG. 3*c* and FIG. 4*c*.

In an embodiment, in the non-actuated state of the force transmission chain 5, the coupling element 7 stays in its decoupled position.

During the inertia movement section 15, depending on the rapidity of the actuation movement, the coupling contour 8 falls into coupling engagement with the counter contour 9 (FIG. 3*b*) or passes the counter contour 9 (FIG. 4*b*). The mass inertia of the coupling element 7 prevents an immediate spring biased falling of the coupling element 7 into the coupling position during the actuation movement. Basically, it is the mass as well as the mass distribution of the coupling element 7, that defines whether the spring bias of the coupling element 7 causes coupling (FIG. 3*b*) or decoupling (FIG. 4*b*) during the actuation movement.

Interesting is now the fact that during the reverse movement the coupling element 7 is deflected into its decoupling position, which is shown in FIG. 3*a*, 4*a*. For this a reset contour 17 can be provided, wherein the coupling element 7 slides along the reset contour 17 during the reverse movement, deflecting the coupling element 7 into the decoupling position (sequence from FIG. 3*c* to FIG. 3*a* and sequence from FIG. 4*c* to FIG. 4*a*).

Regarding the reverse movement under normal operation it is to be noted that starting from the actuated state shown in FIG. 3*c*, this movement goes along with a relative movement between the two force transmission chain sections 5*a*, 5*b*, such that the coupling element 7 may slide along the reset contour 17 with a follower contour 18.

In particular for ensuring the above noted relative movement between the force transmission chain sections 5*a*, 5*b*, a reset spring 19 is provided for spring biasing the coupling element 7 along the reset contour 17. In an embodiment, the reset spring 19 acts onto the coupling element 7 in FIGS. 3 and 4 to the right.

A particularly compact structure results from the fact, that the reset spring 19 and the above noted coupling spring 14 are realized as one and the same spring. Generally it is possible that two separate springs are being realized.

FIGS. 3*a* and 4*a* show that a blocking contour 20 is arranged at the counter contour 9, which prevents the coupling element 7 from falling into the coupling position during the non-actuated state of the force transmission chain. This blocking contour 20 can comprise a ramp-like contour which dynamically deflects the coupling element 7 when a crash induced actuation movement of the force transmission chain 5 occurs.

There are various possibilities for the realization of the counter contour 9 possible. In an embodiment, the counter contour 9 is hook-shaped, wherein in the coupling position the coupling element 7 with its coupling contour 8 is hooked to the counter contour 9. For good engagement with the hook-like counter contour 9, the coupling element 7 can be designed bolt-like.

Figure 2:
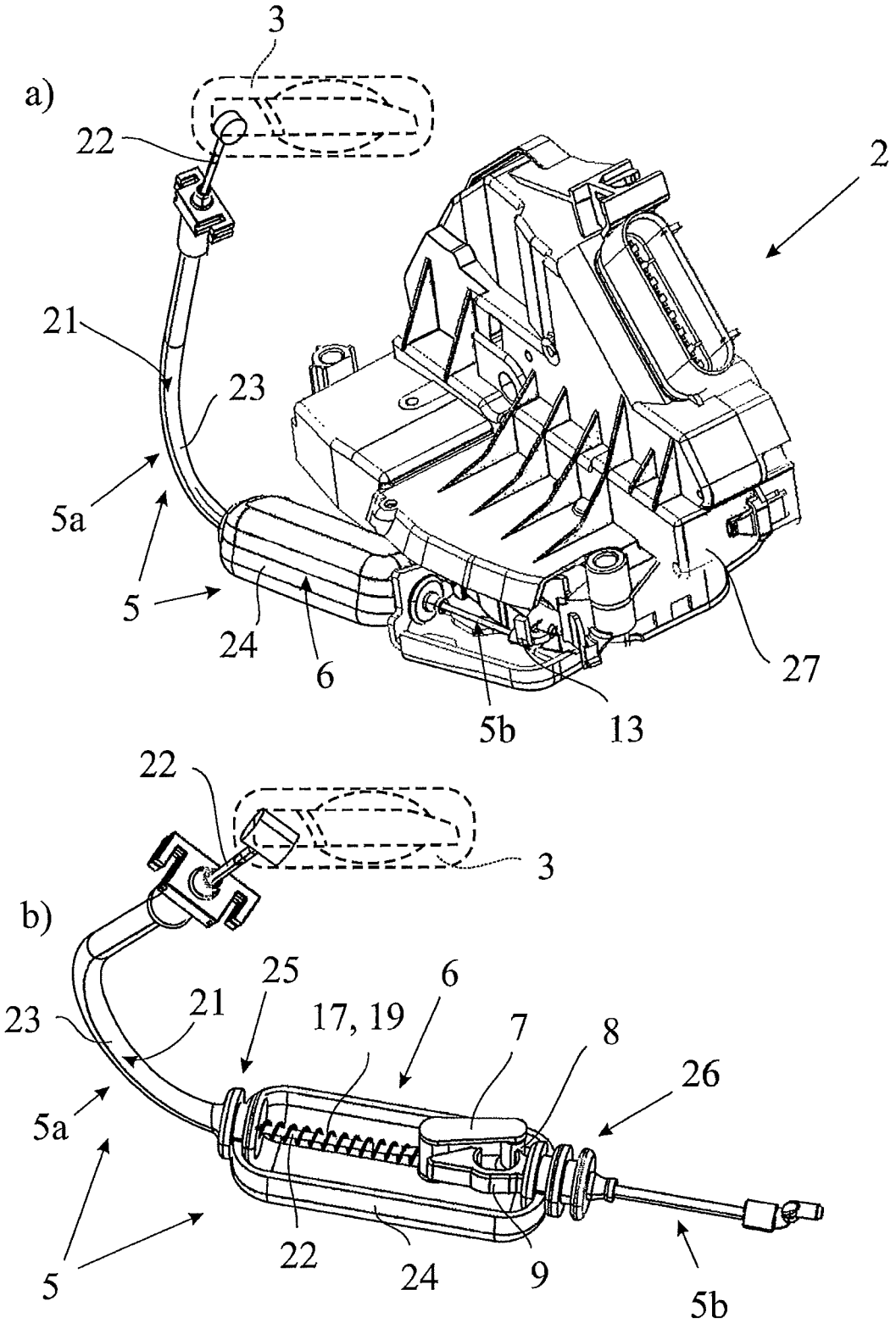
FIG. 2 illustrates a) the motor vehicle lock of the motor vehicle door lock arrangement shown in FIG. 1, and b) the crash coupling arrangement of the motor vehicle door lock arrangement shown in FIG. 1, each in a partly demounted state.

It has been noted already that the proposed solution may be realized in various structural ways. FIG. 2 shows that one force transmission chain section 5*b* is part of the motor vehicle lock 2, while the crash coupling arrangement 6 can be provided separately from the motor vehicle lock 2 and, in some embodiments, attached to the motor vehicle lock 2. As shown in FIG. 2*b* the force transmission chain section 5*b* comprises a cable-like section. However, it may be advantageous that the counter contour 9 is part of the above noted actuation lever 13 of the motor vehicle lock 2.

In an embodiment, the crash coupling arrangement 6 is provided separately from the motor vehicle lock 2, such that it may be attached to the motor vehicle lock 2 as noted above. In addition, the force transmission chain section 5*a* can be provided separately from the motor vehicle lock 2 as well. This separate force transmission chain section 5*a* is advantageously connected to a door handle 3.

It may be pointed out that it is possible that both force transmission chain sections 5*a*, 5*b* are part of the motor vehicle lock 2. This is also applicable for the crash coupling arrangement 6, which may be integrated into the motor vehicle lock 2 as well. In such cases, an additional force transmission chain has to be realized, which provides a driving connection between the door handle 3 and the motor vehicle lock 2.

On the other hand, in an embodiment both force transmission chain sections 5*a*, 5*b* are provided separately from the motor vehicle lock 2. Again, this may well be applicable for the crash coupling arrangement 6, which, when realized separately from the motor vehicle lock 2, allows to flexibly provide or not provide an existing motor vehicle lock 2 with a crash coupling arrangement 6.

It may be pointed out, that at least part of the force transmission chain 5 and/or part of the crash coupling arrangement 6 may be part of a door handle 3, in particular an outer door handle 3 of the motor vehicle door lock arrangement 1.

An especially cost effective and compact structure may be achieved if at least one force transmission chain section 5*a*, 5*b* comprises a bowden arrangement 21 with a bowden cable 22 and a bowden sheath 23, which surrounds the bowden cable 22. The bowden cable 22 runs in a well known manner within and along the bowden sheath 23. In an embodiment, the respective bowden cable 22 provides the deflectable coupling element 7, such that the bowden cable 22 is used for two functions, namely the function of transmitting an actuation movement and the function of ensuring the disconnection of the two force transmission chain sections 5*a*, 5*b*, when the actuation movement surpasses a rapidity threshold. As noted above, the spring bias of the coupling element 7 into its coupling position goes back on the bending elasticity of the bowden cable 22 of the respective force transmission chain 5*a*.

As shown in the drawings, in an embodiment the coupling contour 8 and/or the counter contour 9 is/are provided by an end section/end sections of the bowden cable/bowden cables of the respective force transmission chain sections 5*a*, 5*b*.

According to a second teaching a motor vehicle door lock arrangement 1 with a motor vehicle lock 2 is claimed. For this second teaching, it is of particular importance that the crash coupling arrangement 6 is provided separately from the motor vehicle lock 2. It is also to be noted that for this second teaching various mechanical structures for the coupling element 7 are possible besides the structure of a bendable coupling element 7. Reference is made to all explanations given for the first teaching.

According to a third teaching, a crash coupling arrangement 6 can be provided separately from the motor vehicle lock 2. Again, reference is made to the explanations given for the aforementioned teachings.

As shown in the drawings the crash coupling arrangement 6 comprises a housing 24, which carries the coupling element 7 with its coupling contour 8 and which carries the counter contour 9. The housing 24 can be closed with the exception of the interface areas 25, 26 for the two force transmission chain sections 5*a*, 5*b*. As shown in the drawings, the housing of the crash coupling arrangement 6 is realized separately from the housing of the motor vehicle lock 2. The crash coupling arrangement 6 is a crash module that may be added to an existing motor vehicle lock 2 as an independently produced module.

What is claimed is:

1. A motor vehicle door lock arrangement with a motor vehicle lock, wherein a force transmission chain is provided and wherein an actuation movement may be transmitted via the force transmission chain for opening of the motor vehicle lock, wherein a crash coupling arrangement is provided between two force transmission chain sections, which comprises a coupling element with a coupling contour assigned to one force transmission chain section and which comprises a counter contour assigned to the other force transmission chain section, wherein the coupling element is deflectable into a coupling position, in which its coupling contour is coupled to the counter contour, thereby interconnecting the two force transmission chain sections, and into a decoupling position, in which its coupling contour is decoupled from the counter contour, thereby disconnecting the two force transmission chain sections, wherein an inertial characteristic of the coupling element causes the coupling contour to become or to stay decoupled from the counter contour, when the actuation movement surpasses a rapidity threshold, and causes the coupling contour to become or to stay coupled to the counter contour, when the actuation movement is below the rapidity threshold, wherein the coupling element is at least partly bendable and wherein the coupling element is deflectable into said positions by bending it into said positions, and wherein at least one force transmission chain section comprises a bowden arrangement with a bowden cable and a bowden sheath, wherein the respective bowden cable provides the deflectable coupling element.

2. A motor vehicle door lock arrangement according to claim 1, wherein the motor vehicle lock comprises a catch and a pawl, which is assigned to the catch, wherein the catch can be brought into an opening position and into a closed position, wherein the catch, which is in the closed position, is or may be brought into holding engagement with a lock striker, wherein the pawl may be brought into an engagement position, in which it is in blocking engagement with the catch, wherein for opening of the motor vehicle lock the pawl may be deflected into a release position, in which it releases the catch.

3. A motor vehicle door lock arrangement according to claim 1, wherein for deflecting the coupling element, the coupling element is elastically bendable.

4. A motor vehicle door lock arrangement according to claim 1, wherein the actuation movement of the force transmission chain goes along with an actuation movement of the coupling element, which actuation movement of the coupling element is oriented basically laterally with respect to the deflection movement of the coupling element.

5. A motor vehicle door lock arrangement according to claim 1, wherein the coupling element is spring biased into its coupling position.

6. A motor vehicle door lock arrangement according to claim 1, wherein the actuation movement of the force transmission chain is followed by a reverse movement of the force transmission chain back into a non actuated state.

7. A motor vehicle door lock arrangement according to claim 6, wherein during the reverse movement the coupling element is deflected into its decoupling position.

8. A motor vehicle door lock arrangement according to claim 7, wherein a reset spring is provided for spring biasing the coupling element along a reset contour.

9. A motor vehicle door lock arrangement according to claim 1, wherein the actuation movement comprises an inertia movement section, which is followed by a driving movement section, wherein during the inertia movement section the inertial characteristic of the coupling element causes coupling to or decoupling from the counter contour depending on the rapidity of the actuation movement and wherein during the driving movement section the actuation movement is being transmitted to the motor vehicle lock or runs free depending on the coupling state of the crash coupling arrangement.

10. A motor vehicle door lock arrangement according claim 1, wherein a blocking contour is arranged at the counter contour which prevents the coupling element from falling into the coupling position during the non actuated state of the force transmission chain.

11. A motor vehicle door lock arrangement according claim 1, wherein the counter contour is hook-shaped and wherein in the coupling position the coupling element is hooked to the counter contour.

12. A motor vehicle door lock arrangement according claim 1, wherein at least one section of the force transmission chain is part of the motor vehicle lock.

13. A motor vehicle door lock arrangement according to claim 1, wherein one or more of the crash coupling arrangement and at least one force transmission chain section is provided separately from the motor vehicle lock.

14. A motor vehicle door lock arrangement according to claim 3, wherein for deflecting the coupling element, the coupling element comprises an elastically bendable wire or strip.

15. A motor vehicle door lock arrangement with a motor vehicle lock, wherein a force transmission chain is provided and wherein an actuation movement may be transmitted via the force transmission chain for opening of the motor vehicle lock, wherein a crash coupling arrangement is provided between two force transmission chain sections, which comprises a coupling element with a coupling contour assigned to one force transmission chain section and which comprises a counter contour assigned to the other force transmission chain section, wherein the coupling element is deflectable into a coupling position, in which its coupling contour is coupled to the counter contour, thereby interconnecting the two force transmission chain sections, and into a decoupling position, in which its coupling contour is decoupled from the counter contour, thereby disconnecting the two force transmission chain sections, wherein an inertial characteristic of the coupling element causes the coupling contour to become or to stay decoupled from the counter contour, when the actuation movement surpasses a rapidity threshold, and causes the coupling contour to become or to stay coupled to the counter contour, when the actuation movement is below the rapidity threshold, wherein the crash coupling arrangement is provided separately from the motor vehicle lock, and wherein at least one force transmission chain section comprises a bowden arrangement with a bowden cable and a bowden sheath, wherein the respective bowden cable provides the deflectable coupling element.

16. A crash coupling arrangement for the insertion between two sections of a force transmission chain for a motor vehicle lock, wherein in the installed state, an actuation movement may be transmitted via the force transmission chain for opening of the motor vehicle lock, wherein the crash coupling arrangement comprises a coupling element with a coupling contour assigned to one force transmission chain section and comprises a counter contour assigned to the other force transmission chain section, wherein the coupling element is deflectable into a coupling position, in which its coupling contour is coupled to the counter contour, thereby interconnecting the two force transmission chain sections, and into a decoupling position, in which its coupling contour is decoupled from the counter contour, thereby disconnecting the two force transmission chain sections, wherein an inertial characteristic of the coupling element causes the coupling contour to become or to stay decoupled from the counter contour, when the actuation movement surpasses a rapidity threshold, and causes the coupling contour to become or to stay coupled to the counter contour, when the actuation movement is below the rapidity threshold, wherein at least one force transmission chain section comprises a bowden arrangement with a bowden cable and a bowden sheath, wherein the respective bowden cable provides the deflectable coupling element.

17. A crash coupling arrangement according to claim 16, wherein the crash coupling arrangement comprises a housing, which carries the coupling element with its coupling contour and which carries the counter contour.

* * * * *